US006962395B2

(12) United States Patent
Mouthaan

(10) Patent No.: US 6,962,395 B2
(45) Date of Patent: Nov. 8, 2005

(54) NON-ROTATABLE PROTECTIVE MEMBER, CUTTING TOOL USING THE PROTECTIVE MEMBER, AND CUTTING TOOL ASSEMBLY USING THE PROTECTIVE MEMBER

(75) Inventor: Daniel J. Mouthaan, Williamsburg, MI (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 10/773,690

(22) Filed: Feb. 6, 2004

(65) Prior Publication Data

US 2005/0173966 A1 Aug. 11, 2005

(51) Int. Cl.[7] ..... E21C 37/00
(52) U.S. Cl. ..... 299/104; 299/103
(58) Field of Search ..... 299/104, 79.1, 299/103, 95

(56) References Cited

U.S. PATENT DOCUMENTS

| | | | | |
|---|---|---|---|---|
| 3,746,396 | A * | 7/1973 | Radd | 299/104 |
| 4,346,934 | A | 8/1982 | College et al. | |
| 4,632,463 | A | 12/1986 | Sterwerf, Jr. | |
| 4,818,027 | A | 4/1989 | Simon | |
| 5,007,685 | A | 4/1991 | Beach et al. | |
| 5,374,111 | A | 12/1994 | Den Besten et al. | |
| 5,931,542 | A * | 8/1999 | Britzke et al. | 299/104 |
| 6,113,195 | A | 9/2000 | Mercier et al. | |
| 6,164,728 | A | 12/2000 | Sollami | |
| 6,176,552 | B1 | 1/2001 | Topka, Jr. et al. | |
| 6,244,665 | B1 | 6/2001 | Bise et al. | |
| 6,357,832 | B1 | 3/2002 | Sollami | |
| 6,371,567 | B1 * | 4/2002 | Sollami | 299/104 |
| 6,478,383 | B1 | 11/2002 | Ojanen et al. | |
| 6,508,516 | B1 * | 1/2003 | Kammerer | 299/104 |
| 6,644,755 | B1 | 11/2003 | Kammerer | |
| 2003/0047985 | A1 | 3/2003 | Stiffler | |

FOREIGN PATENT DOCUMENTS

EP 0 639 437 A1 3/1993

OTHER PUBLICATIONS

Kennametal Catalog, "Road Planing, Soil Stabilization, and Reclamation Tools", B01-1(12)D1 (2001) 43 pgs.

* cited by examiner

*Primary Examiner*—John Kreck
(74) *Attorney, Agent, or Firm*—Matthew W. Smith

(57) ABSTRACT

A cutting assembly that includes a block that has a body that contains a block bore. A sleeve has a body that contains a bore that has an axial forward end and a forward surface surrounding the bore at the axial forward end thereof. The sleeve further contains at least one scallop beginning at extending in an axial rearward direction from the forward surface. There is a cutting tool rotatably contained within the bore of the sleeve. There is a non-rotatable washer that has a washer body that has a peripheral edge wherein the washer body contains at least one indention adjacent to peripheral edge. The indention of the non-rotatable washer is received within the scallop.

26 Claims, 9 Drawing Sheets

NON-ROTATABLE PROTECTIVE MEMBER, CUTTING TOOL USING THE PROTECTIVE MEMBER, AND CUTTING TOOL ASSEMBLY USING THE PROTECTIVE MEMBER

BACKGROUND OF THE INVENTION

The present invention pertains to a protective member (e.g. a washer-like member) alone, a rotatable cutting tool that uses the protective member, as well as a cutting tool assembly that uses the protective member. More particularly, the invention pertains to a non-rotatable protective member (e.g., a non-rotatable washer) alone, a rotatable cutting tool that uses the non-rotatable protective member, as well as a cutting tool assembly that uses the non-rotatable protective member wherein the cutting tool assembly includes a cutting tool and a holder for the cutting tool wherein the cutting tool carries the non-rotatable protective member that engages the holder so as to be non-rotatable.

One typical use of a rotatable cutting tool is in conjunction with a machine used to break up (or cut) a substrate such as earth strata (e.g., coal, the ground, asphalt pavement, asphaltic concrete, concrete or the like). In its very basic aspects, such a machine includes a driven member (e.g., a chain, a wheel or a drum), a holder either directly or indirectly mounted to the driven member, and a rotatable cutting tool rotatably held in the holder. It is the cutting tool that impinges the earth strata so as to break it into pieces and chunks upon impact.

As can be appreciated these rotatable cutting tools and the holders operate in a severe environment that causes wear on these components, as well as other possible failures due to the severity of the operating conditions. While it is inevitable that the cutting tools experience wear, the ability of the cutting tool to rotate about its central longitudinal axis during operation generally prolongs the useful life of the cutting tool. It can thus be appreciated that features of the cutting tool or cutting tool assembly that facilitate the rotation of the cutting tool during operation are beneficial to the operation of the cutting tool (and cutting too assembly) and the overall operation of the earth strata cutting machine.

As known to those skilled in the art, the useful life of the holder is much longer than the useful life of the cutting tool. Each holder is intended to accommodate many changes of cutting tools held thereby until it is necessary to replace the holder. In the case of an earth strata cutting machine like a road milling machine, it is important to maintain the milling pattern. One factor that influences the milling pattern is the degree of wear that is suffered by the forward face of the holder. In order to reduce the wear on the forward face of the holder a washer has been carried by the cutting tool that is mediate of the cutting tool and holder. The washer protects the forward face of the holder from wear.

One such cutting tool that carries a protective washer is shown and described in U.S. Pat. No. 6,478,383 to Ojanen et al. The cutting tool of this patent carries a washer. When the cutting tool is received within the bore of a block, which is attached to a driven member, the washer is sandwiched between the rearwardly facing surface of the enlarged diameter portion of the cutting tool and the forward face of the holder.

Another cutting tool that uses a protective member is shown and described in U.S. Pat. No. 6,508,516 B1 to Kammerer. The '516 patent discloses a washer that includes a tab. The tab engages grooves in a holder so that the washer does not rotate relative to the holder.

While at least at the beginning of a milling cycle, the structure disclosed in U.S. Pat. No. 6,508,516 would be expected to provide a non-rotatable washer; however, over time the structure may be susceptible to problems. One such problem is that the groove that engages the tab may become clogged with debris. Obviously, this condition could compromise the integrity of the connection between the tab and the groove and result in the loss of the non- rotatable feature of the washer. Another problem is that over the course of operation the tab is exposed along the side of the tool so as to be susceptible to wearing away. The erosion of the tab could compromise the integrity of the connection between the tab and the groove and result in the loss of the non-rotatable feature of the washer.

U.S. Pat. No. 5,931,542 to Britzke et al. discloses a cutting tool that includes a protective member (i.e., a washer). The washer interconnects to the resilient retainer carried by the cutting tool. The connection between the washer and the retainer sleeve keeps the washer from rotating relative to the holder. The location of the connection between the washer and the sleeve is close to the longitudinal axis of the tool so that higher forces are applied to this connection than if the connection were more radially outward.

While the above patents show washers that do not rotate relative to the holder, it would still be desirable to provide an improved cutting tool (as well as a) cutting tool assembly that uses a non-rotatable protective member such as a washer.

It would be desirable to provide an improved cutting tool (as well as a cutting tool assembly) that uses a non-rotatable washer (i.e., non-rotatable protective member) that directly engages the holder that holds the cutting tool in such a fashion so that the washer is not susceptible to wear that compromises the integrity of the non-rotatable characteristic of the washer. In this regard, it would be especially desirable to provide such a non-rotatable washer that engages a commercially existing holder (e.g., the holder shown in U.S. Pat. No. 6,244,665 to Bise et al.) that does not require any structural modifications to receive the non-rotatable washer. It would be a further advantage if the non- rotatable washer did not compromise the integrity of the desirable features of the holder, such as, for example in the case of U.S. Pat. No. 6,244,665, the ability of the access grooves to assist in the removal of the cutting tool.

It would also be desirable to provide an improved cutting tool (as well as a cutting tool assembly) that uses a non-rotatable washer wherein the connection that provides the non-rotatable feature is protected from erosion or wear during operation.

It would also be desirable to provide an improved cutting tool (as well as a cutting tool assembly) that uses a non-rotatable washer (a non-rotatable protective member) that has a high torque strength for the connection that provides for the non-rotatable feature of the washer.

It would also be desirable to provide an improved cutting tool (as well as a cutting tool assembly) that uses a non-rotatable washer (i.e., a non-rotatable protective member) that can be used in conjunction with a rotatable washer.

It would also be desirable to provide an improved cutting tool (as well as a cutting tool assembly) that uses a pair of the non-rotatable washers.

SUMMARY OF THE INVENTION

In one form thereof, the invention is a cutting tool assembly useful for generating cutting debris that comprises a block that contains a block bore. There is a sleeve that contains a sleeve bore wherein the sleeve has an axial forward end and a forward surface surrounding the bore at the axial forward end thereof. The sleeve contains at least one scallop beginning at and extending in an axial rearward direction from the forward surface. The assembly includes a cutting tool that is rotatably contained within the sleeve bore. The assembly also has a non-rotatable washer that has a washer body that has a peripheral edge. The washer body contains at least one indention adjacent to the peripheral edge. The indention of the non-rotatable washer is received within the scallop.

In another form thereof, the invention is a non-rotatable washer for use with a cutting tool and a member that rotatably receives the cutting tool. The non-rotatable washer comprises a washer body that has a peripheral edge. The washer body contains at least one indention adjacent the peripheral edge. The cutting tool carries the washer and the indention registers with the member so as to render the washer non-rotatable.

In still another form thereof, the invention is a cutting tool assembly useful for generating cutting debris that comprises a holder that contains a bore that has an axial forward end. The holder further contains a forward surface surrounding the bore at the axial forward end of the bore. The holder contains at least one scallop beginning at and extending in an axial rearward direction from the forward surface. The assembly includes a cutting tool that is rotatably contained within the bore of the holder. The assembly further includes a non- rotatable washer that has a washer body having a peripheral edge wherein the washer body contains at least one indention adjacent the peripheral edge. The indention of the non-rotatable washer is received within the scallop.

In still another form thereof, the invention is a cutting tool assembly useful for generating cutting debris that comprises a holder that contains a bore that has an axial forward end. The holder further contains a forward surface surrounding the bore at the axial forward end of the bore. The holder contains a plurality of scallops beginning at and extending in an axial rearward direction from the forward surface. The assembly includes a cutting tool that is rotatably contained within the bore of the holder. The assembly further includes a non-rotatable washer that has a washer body having a peripheral edge wherein the washer body contains at least one indention adjacent the peripheral edge. The number of scallops in the holder is greater than the number of indentions in the non-rotatable washer. The indention of the non-rotatable washer is received within a selected one of the scallops wherein there is at least one of the scallops that does not receive one of the indentions.

BRIEF DESCRIPTION OF THE DRAWINGS

The following is a brief description of the drawings that form a part of this patent application.

DETAILED DESCRIPTION OF THE INVENTION

Figure 1:
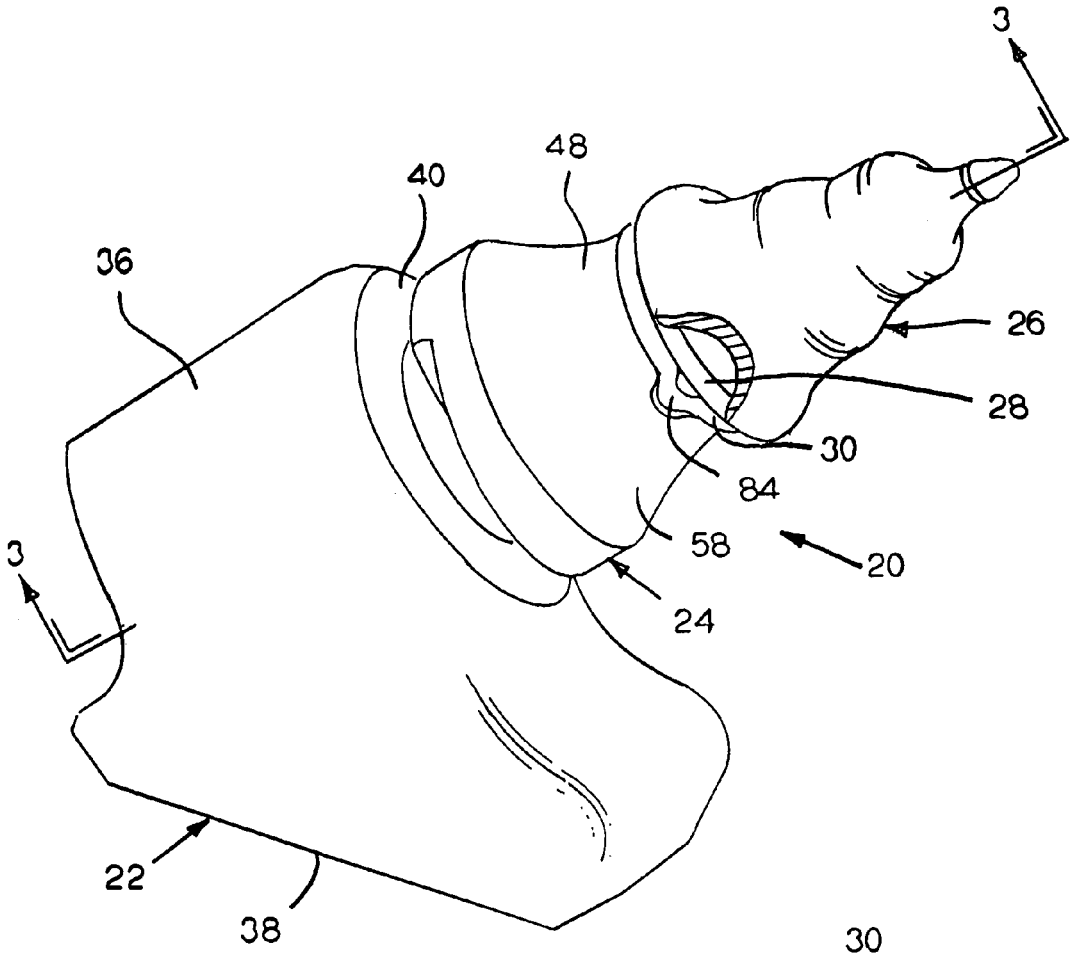
FIG. 1 is an isometric view of a first specific embodiment of a cutting tool assembly wherein the cutting tool assembly includes a block, a sleeve, a non-rotatable washer, a rotatable washer, and a cutting tool wherein a portion of the cutting tool is broken away to show the non-rotatable and the rotatable washer.

Referring to the drawings, FIG. 1 illustrates a first embodiment of a cutting tool assembly useful for generating cutting debris upon impinging the earth strata, and generally designated as 20. Cutting tool assembly 20 includes a holder 22 that is affixed to a driven member (not illustrated) such as, for example, a wheel, a chain or a drum as in the case of a road milling machine that may be used to mill the surface of an asphaltic roadway. The cutting tool assembly 20 further includes a sleeve 24 that, as described in more detail hereinafter, is retained within the central bore of the block 22. The cutting tool assembly 20 also includes a rotatable cutting tool 26 that carries a flat washer 28 and a non-rotatable washer 30. The rotatable cutting tool is rotatable retained within the bore of the sleeve 24. A portion of the cutting tool 26 is broken away in FIG. 1 so as to be able to illustrate the flat washer 28 and the non-rotatable washer 30. FIG. 1 shows these components of the first specific embodiment of the cutting tool assembly in an assembled condition that will be described in more detail hereinafter.

Figure 2:
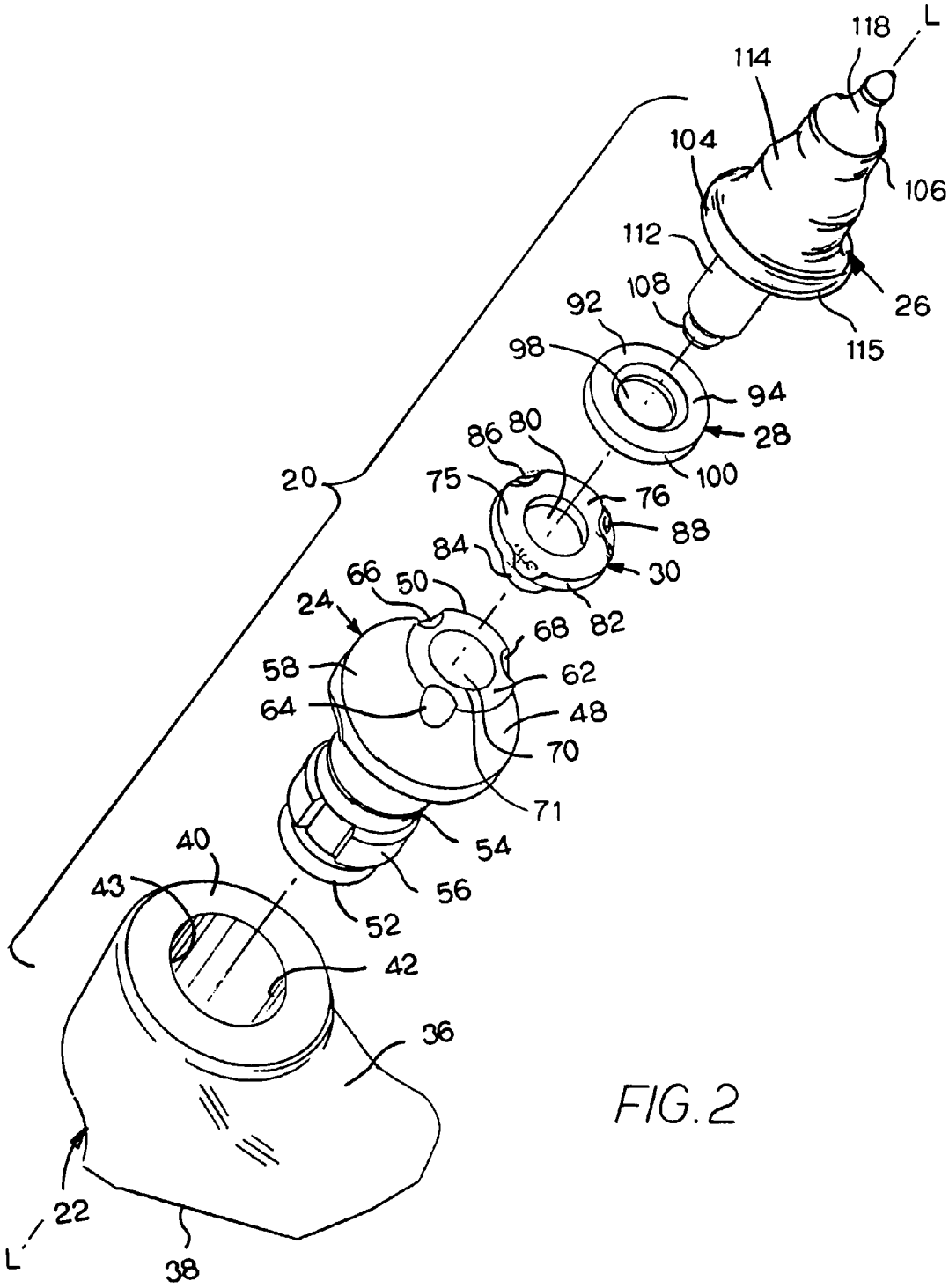
FIG. 2 is an isometric view of the first specific embodiment of the cutting tool assembly of FIG. 1 wherein the components are exploded apart from one another.

Referring to FIG. 2, there is illustrated cutting tool assembly 20 in a exploded condition wherein the components are exploded apart from one another along the central longitudinal axis L—L of the cutting tool assembly. Each component will now be described in more detail.

Block 22 has a block body 36 that presents a base 38 and an axial forward face 40 that surrounds a central bore 42. The block 22 is the component that is mounted or affixed to a driven member. In the case of the road milling machine, the driven member is a drum. The drum contains a plurality (e.g., generally at least one hundred) of blocks mounted (such as by welding) in a one-selected pattern to the surface of the drum. The axial forward face 40 presents a smooth surface that faces in an axial forward direction. The axial forward face 40 surrounds the bore 42 at the axial forward end 43 thereof.

Sleeve 24 has a sleeve body 48 that has an axial forward end 50 and an axial rearward end 52. Sleeve body 48 presents a shank 54 adjacent the axial rearward end 52. Shank 54 carries a resilient retainer 56. Shank 54 has a reduced diameter as compared to the remainder of the sleeve body 48. The sleeve body 48 further has a head portion 58 that is adjacent to the axial forward end 50 of the sleeve body 48. Head portion 58 presents an axial rearward facing shoulder 60 that is at the juncture of the shank 54 and the head portion 58 of the sleeve body 48. Axial rearward facing shoulder 60 has a smooth, flat surface. In this first specific embodiment, the sleeve 24 can be considered to be a holder that rotatably receives the rotatable cutting tool 26.

The sleeve body 48 also has an axial forward face 62. The sleeve body 48 contains a central sleeve bore 70 that has an axial forward end 71. The axial forward face 62 surrounds the sleeve bore 70 at the axial forward end 71 thereof. The sleeve body 48 further contains a trio of scallops (64, 66, 68) at the axial forward end 50 thereof.

Figure 2A:
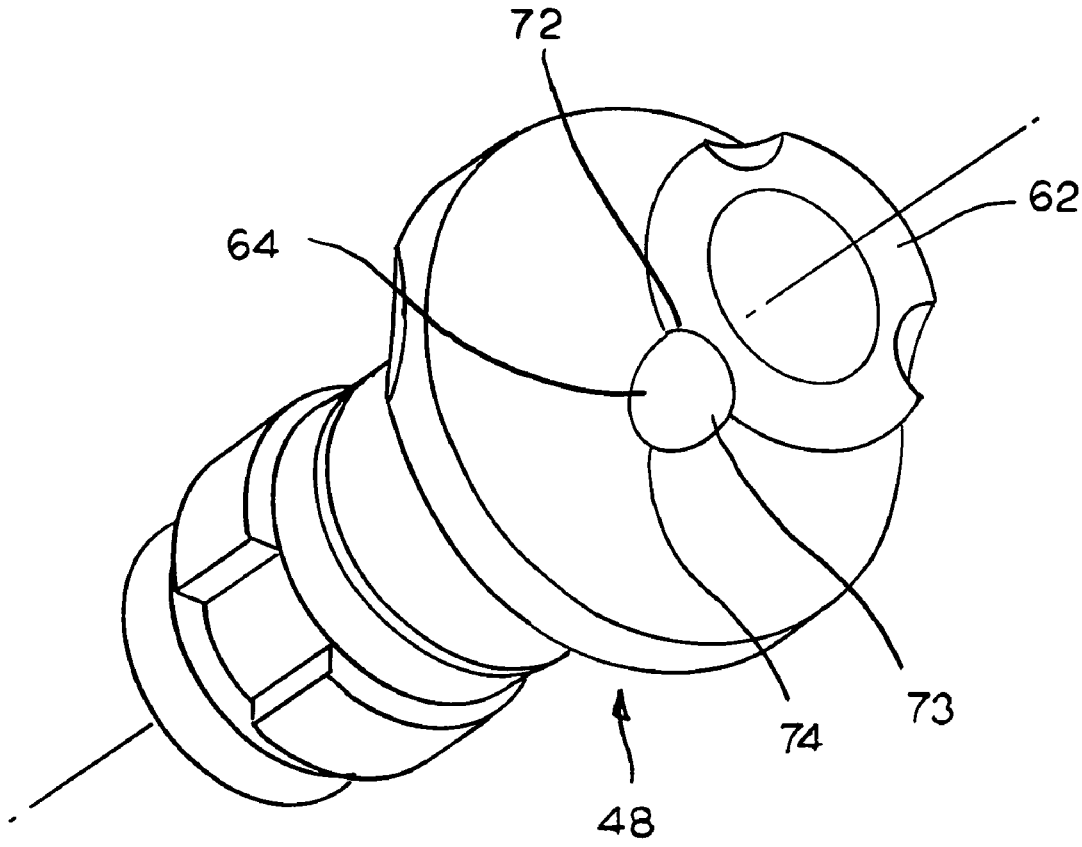
FIG. 2A is an isometric view of the sleeve showing the scallops.

Referring especially to FIG. 2A and referring to scallop 64 that is representative of the other scallops (66, 68), each one of these scallops (64, 66, 68) has an axial forward end 72 that intersects the axial forward face 62 of the sleeve 48. The scallop 64 then presents a concave surface 73 that becomes narrower and shallower as it moves in (or along) the axial rearward direction until it terminates at the axial rearward end 74 thereof. Scallops like scallops 64, 66 and 68 are shown and described in U.S. Pat. No. 6,478,383 B1 to Ojanen et al. and U.S. Pat. No. 6,244,665 B1 to Bise et al. and applicant hereby incorporates these two patents by reference herein. Although it will be discussed more hereinafter, it should be appreciated that the access grooves (or scallops) of the tool holder of the Bise et al. patent expose a portion of the underside of the flange of the cutting tool to assist in the removal of the cutting tool from the tool holder.

Cutting tool assembly 20 further includes a non-rotatable washer 30 that is non-rotatable relative to the sleeve 24 when the cutting tool assembly 20 is in an assembled condition such as shown in FIG. 1. Non-rotatable washer 30 is of a generally circular shape and has a washer body 75. Washer body 75 has an axial forward surface 76 and an axial rearward surface 78. Washer body 75 contains a central aperture 80, as well as presents a circumferential edge 82. Non-rotatable washer 30 has a diameter of a dimension "E".

Figure 4:
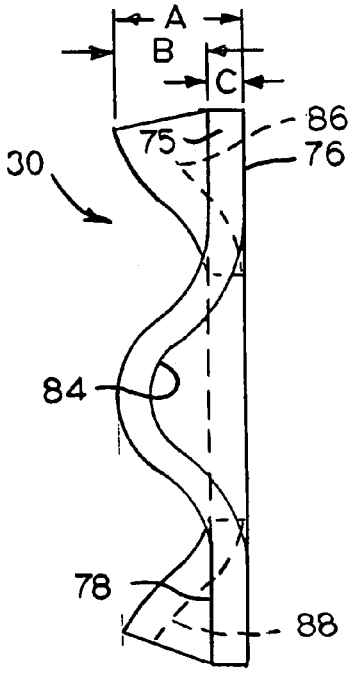
FIG. 4 is a side view of the non-rotatable washer of FIG. 1 wherein the non-rotatable washer contains a trio of indentions.
Figure 5:
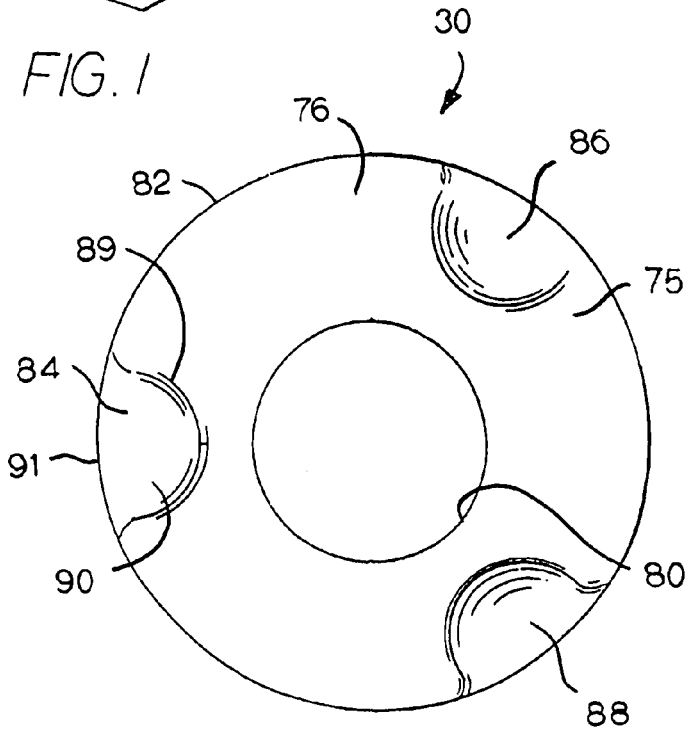
FIG. 5 is a top view of the non-rotatable washer of FIG. 4.

Washer body 75 further contains a trio of indentions (84,86,88) that are equi-spaced about and adjacent to the circumferential (or peripheral) edge 82 of the washer body 75. Referring to indention 84 as representative of the other indentions 86 and 88, indention 84 has a radial inward end 89 that is flush with the axial forward surface 76 of the washer body 75. Indention 84 presents a concave (or arcuate) surface 90 that extends in a radial outward direction. Indention 84 extends out until it terminates at its radial outward end 91 located at the circumferential edge 82 of the washer body 75. As shown in FIG. 4, the thickness of the washer body 75 is dimension "C" wherein the depth of the indention 84 is dimension "B" so that the total maximum thickness of the non-rotatable washer 30 is dimension "A".

Cutting tool assembly 20 also includes flat washer 28 that has a diameter of a dimension "E". The flat washer 28 is free to rotate when the cutting tool assembly 20 is in an assembled condition. Flat washer 28 has a washer body 92 that presents a smooth, flat forward surface 94 and a smooth, flat rearward surface 96. Washer body 92 contains a central aperture 98, and has a circumferential edge 100.

Cutting tool assembly 20 has a cutting tool 26 that is like the cutting tool shown and described in U.S. Pat. No. 6,478,383 B1 to Ojanen et al. Cutting tool 26 has an elongate cutting tool body 104 that has an axial forward end 106 and an axial rearward end 108. Cutting tool body 104 also presents a shank 110 adjacent the axial rearward end 108 thereof. Shank 110 carries a resilient sleeve retainer 112. Cutting tool body 104 further has a head portion 114 adjacent to the axial forward end 106 thereof. There is a rearwardly facing shoulder 116 at the juncture of the shank 110 and the head portion 114. Rearwardly facing shoulder 116 presents a smooth, flat surface. Cutting tool body 104 also has an enlarged diameter portion 115, which has a diameter equal to dimension "D", near the juncture of the shank 110 and the head portion 114. Cutting tool 26 has a hard cemented carbide tip 118 affixed such as by brazing to a socket (not illustrated) at the axial forward end 106 of the cutting tool body 104.

Referring to the cutting tool assembly 20 in an assembled condition, the shank 54 of the sleeve 24 is contained within the bore 42 of the block 22 so that the resilient retainer 56 assists in the retention of the sleeve 24 in the block 22. In addition to the retainer 56, the shank 54 of the sleeve 24 has a slight reverse taper that causes a mechanical locking between the sleeve 24 and the bore wall of the block 22. Such reverse taper is described in U.S. Pat. No. 6,176,552 to Topka et al. wherein this patent is hereby incorporated by reference herein. Hence, the sleeve 24 is non-rotatable with respect to the block 22. When in this position the axial forward face 40 of the block 22 is spaced axial rearward of the rearwardly facing shoulder 60 of the sleeve 24.

The cutting tool 26 is rotatably retained within the bore 70 of the sleeve 24. In this regard, the shank 110 of the cutting tool 26 is received within the sleeve bore 70 in such a fashion that the resilient retainer 112 maintains the connection between the cutting tool 26 and the sleeve 24. Intermediate of the axial forward face 62 of the sleeve 24 and the rearwardly facing shoulder 116 of the cutting tool 26 are the non-rotatable washer 30 and the rotatable washer 28.

Figure 3:
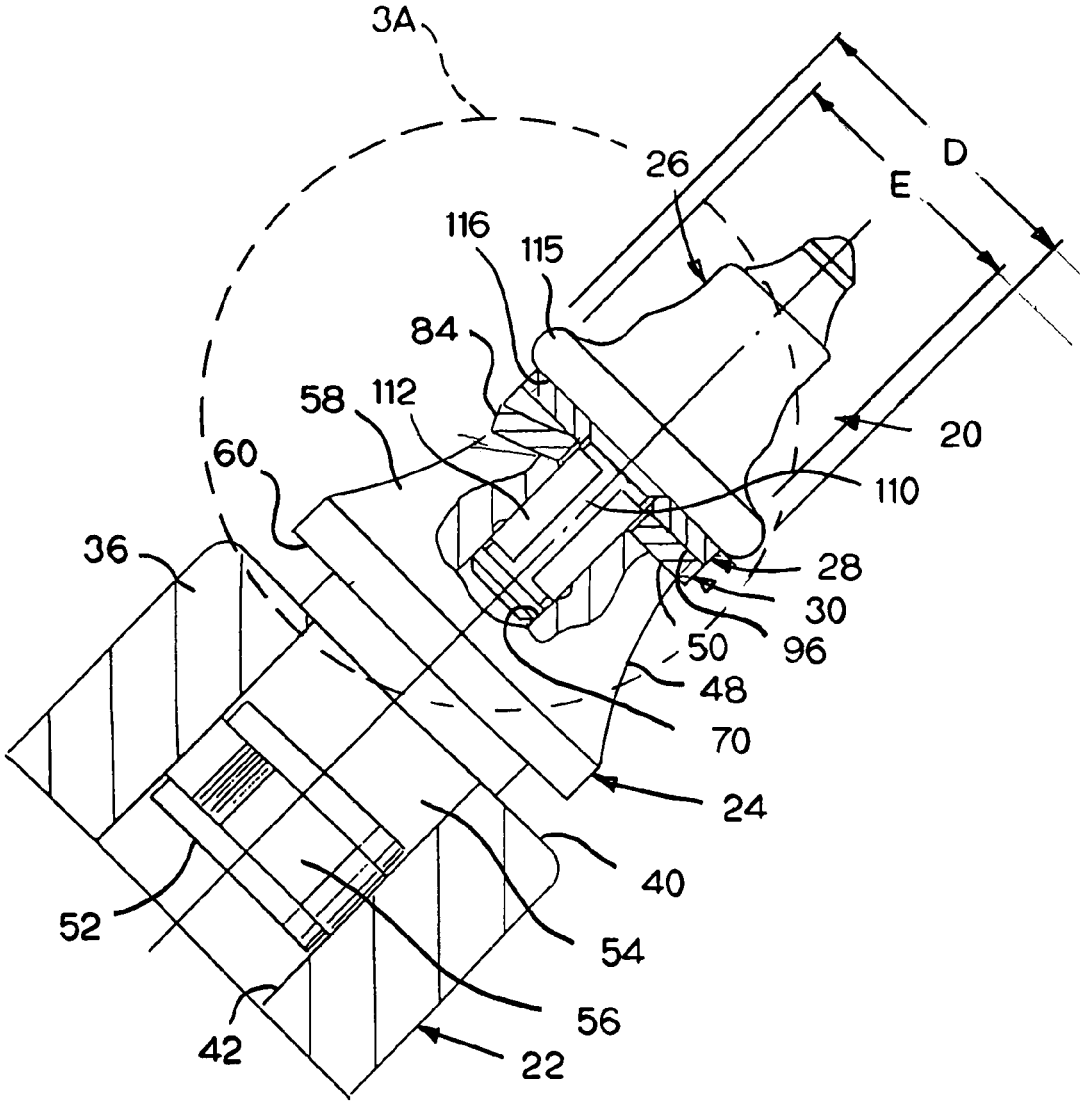
FIG. 3 is a partial cross-sectional view taken along section line 3—3 of FIG. 1 showing the block in cross-section, the sleeve in partial cross-section, the non-rotatable washer in cross-section, and the rotatable washer in cross-section.

The rearward surface 78 of the non-rotatable washer 30 is in contact with the axial forward face 62 of the sleeve 24. The indentions (84, 86, 88) of the non-rotatable washer 30 are received by and register with their corresponding scallops (64, 66, 68), respectively. In other words, the portions of the non-rotatable washer 30 that can be considered rearward protrusions are received within the volumes defined by the scallops (64, 66, 68). When in the assembled condition (such as shown in FIGS. 1 and 3) the indentions (84, 86, 88) abut against the surfaces defining the scallops (64, 66, 68) so as to create three separate abutments wherein each abutment restricts or prevents the rotational movement of the non-rotatable washer 30 relative to the sleeve 24.

It should be appreciated that each one of the abutments between the indentions (84, 86, 88) of the non-rotatable washer 30 and the scallops (64, 66, 68) of the sleeve 24 is protected, at least to some extent, from erosion from cutting debris because each abutment is underneath the non-rotatable washer 30. It is because the indentions (84, 86, 88) project in an axial rearward direction so as to engage and abut with the scallops (64, 66, 68) so that the body of the non-rotatable washer 30 helps protect or shield the abutment from erosion due to the cutting debris.

It should also be appreciated that the abutments between the indentions (84, 86, 88) of the non-rotatable washer 30 and the scallops (64, 66, 68) of the sleeve 24 are located at essentially a maximum radial distance away from the central longitudinal axis (L—L) of the cutting assembly 20. Because of this fact, the torque forces exerted on these abutments is less than if the abutments (or connections) were located more toward the central longitudinal axis (L—L) of the cutting assembly 20.

The forward surface 76 of the non-rotatable washer 30 is in contact with the rearward surface 96 of the flat washer 28. The forward surface 94 of washer 28 is in contact with the rearwardly facing shoulder 60 of the cutting tool 26. As is apparent, washer 28 and the non-rotatable washer 30 are sandwiched between the axial forward face 62 of the sleeve 24 and the rearwardly facing shoulder 116 of the cutting tool 26.

During operation, the driven member causes the cutting tool assembly to impinge upon the earth strata. More specifically, the hard cemented carbide tip 118 impinges the earth strata (e.g. an asphaltic roadway) so as to break up and fracture the earth strata thereby generating cutting debris. In operation, the non-rotatable washer 30 functions to protect the axial forward face 62 of the sleeve 24 since the erosion due to the cutting debris will be suffered by the forward face of the non-rotatable washer 30 rather than the axial forward face 62 of the sleeve 24. Obviously, this provides a desirable feature since the sleeve 24 will have a longer useful life as a result of this protection. The axial forward face 62 of the sleeve 24 will also maintain its integrity longer so that the milling pattern, especially in micro milling applications of asphaltic roadways, will also maintain its integrity.

As mentioned above, it is also an advantage that the abutments between the indentions (84, 86, 88) of the non-rotatable washer 30 and the scallops (64, 66, 68) of the sleeve 24 are protected to some extent from erosion caused by impingement of the cutting debris because the abutment is underneath the non-rotatable washer 30. This is a feature that prolongs the non-rotatable condition of the non-rotatable washer 30. It should also be appreciated that the existence of three abutments can enhance the non-rotatable condition of the non- rotatable washer 30 since one and even two of the abutments could fail and the non-rotatable washer 30 would remain engaged to the sleeve 24 in a non-rotatable condition so long as one abutment remains in existence.

It is also an advantage that the cutting tool body 104 has an enlarged diameter portion 115 that has a diameter of a dimension "D" that is greater than the diameter of the washers (28, 30) that each have a diameter of a dimension "E". Because of this difference in diameter, neither one of the washers (28, 30) will be able to wrap itself around the cutting tool 26 during operation so as to cause the cutting tool 26 to not rotate.

Figure 3A:
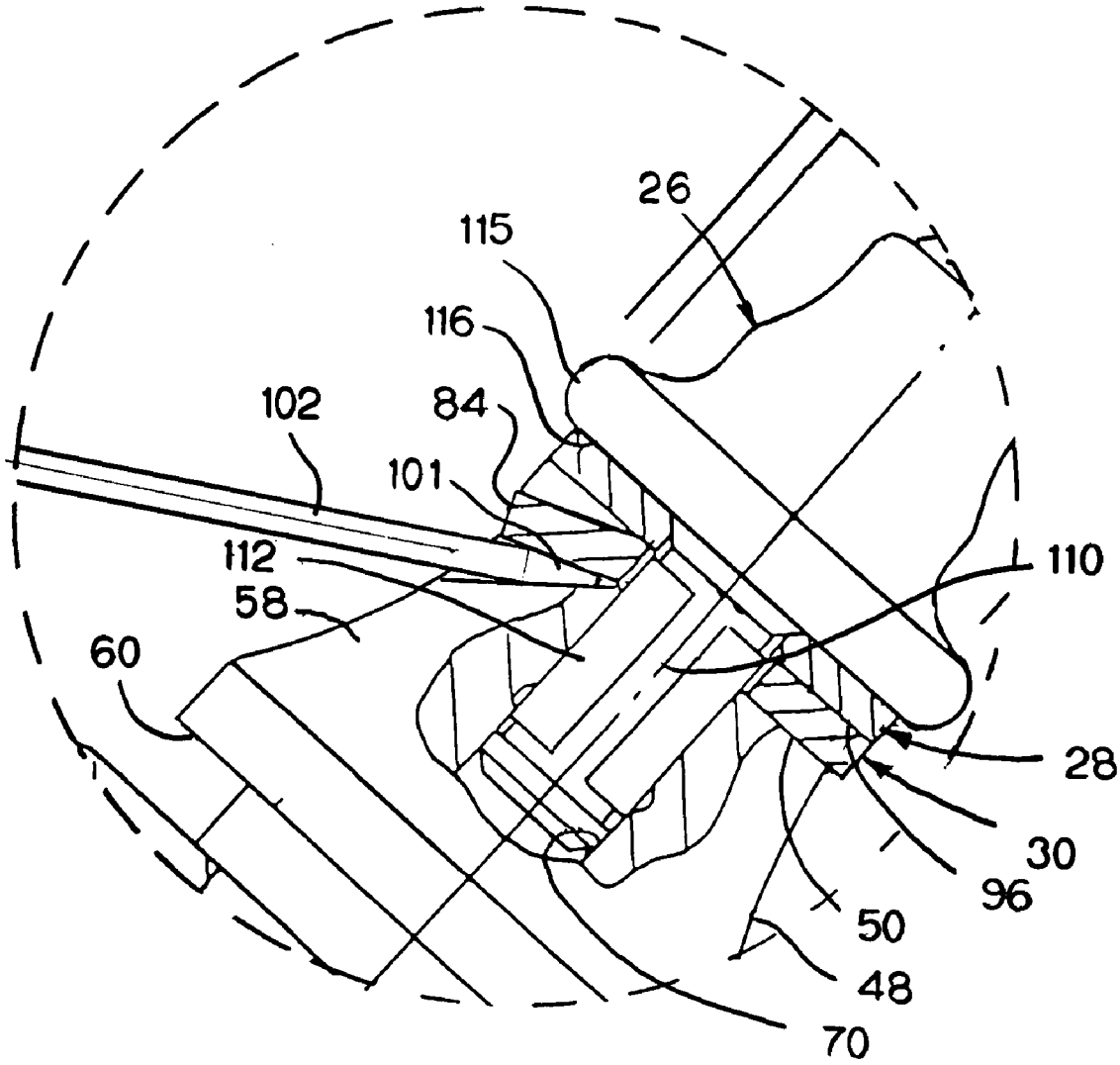
FIG. 3A is an enlarged view of the portion of FIG. 3 showing the relationship between the indention of the non-rotatable washer and the scallops whereby there is enough access for the operator to use a removal tool in the scallop to the remove the cutting tool from the block.

Referring to FIG. 3A, there is shown an enlarged view of the relationship between the indention 84 of the non-rotatable washer 30 and the scallop 64. In this case, there is adequate space to provide access for a removal tool 102 to act against the rearward facing shoulder 116 (either directly or indirectly as in the case where the removal tool 102 contacts the non-rotatable washer 30) and assist in the removal of the cutting tool 26 from the bore 70 of the sleeve 24. As shown in FIG. 3A, the forward end 101 of the removal tool 102 impacts against the rearward surface 78 of the non-rotatable washer 30 so as to assist in the removal of the cutting tool 26.

Figure 6:
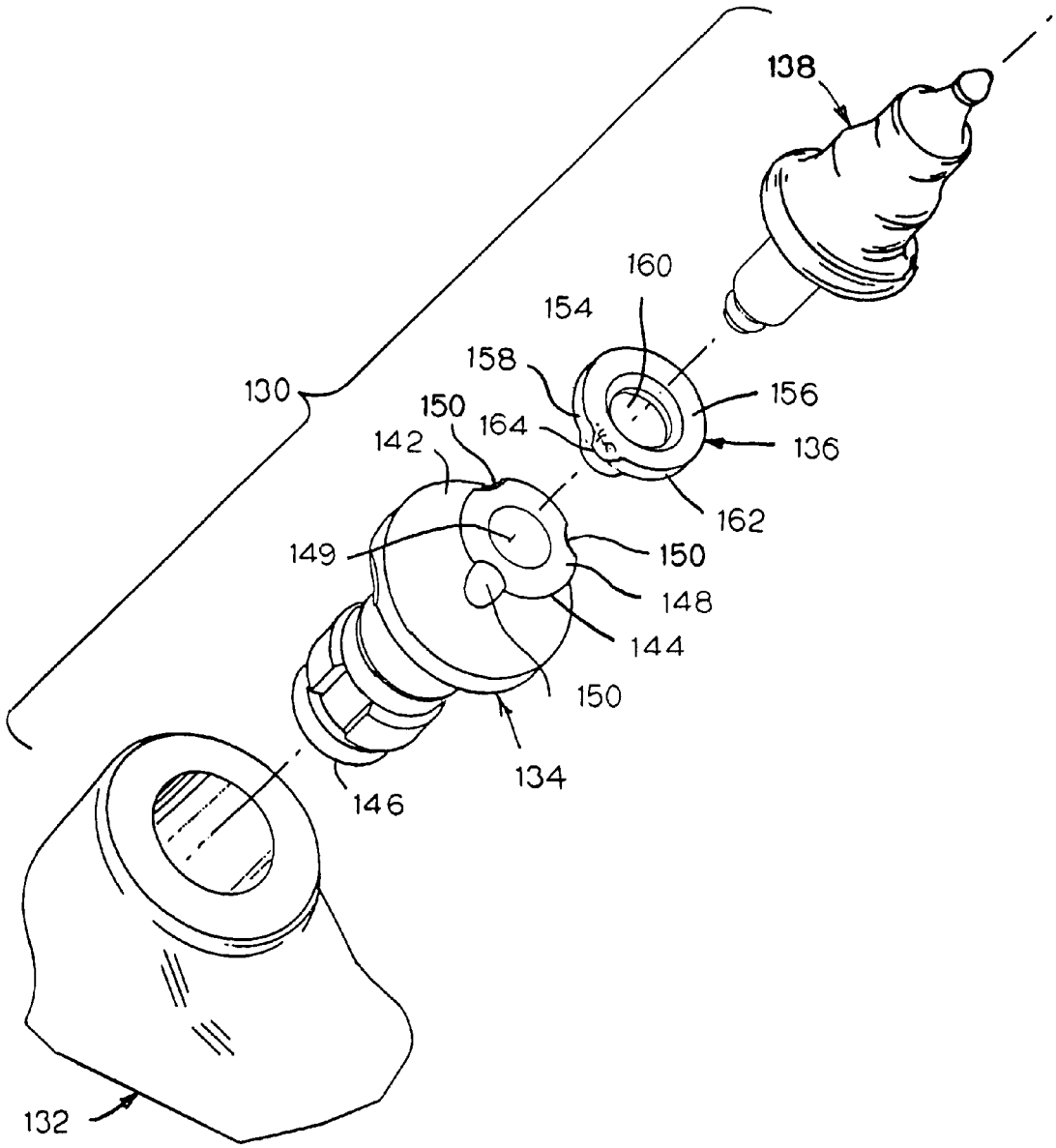
FIG. 6 is an isometric view of a second specific embodiment of a cutting tool assembly wherein the components comprise a block, a sleeve, a non-rotatable washer that contains a single indention, and a cutting tool, and the components are exploded apart from each other.

Referring to FIG. 6, there is illustrated a second specific embodiment of the cutting tool assembly generally designated by brackets 130. Cutting tool assembly 130 includes a block 132, a sleeve 134, a non-rotatable washer 136 and a cutting tool 138. The block 132 is structurally the same as block 22 so that a more detailed description is not necessary. The cutting tool 138 is structurally the same as cutting tool 26 so that a more detailed description is not necessary.

Sleeve 134 has a sleeve body 142 that has an axial forward end 144 and an axial rearward end 146. Sleeve body 142 also presents a forward face 148 at the axial forward end 144 thereof. The forward face 148 surrounds bore 149 at the axial forward end thereof. Sleeve body 142 contains a single scallop 150, rather than three equi-spaced circumferential scallops like sleeve 24, wherein the scallop 150 has a geometry like that of scallop 64 so that a more detailed description is not necessary. In the second specific embodiment, the sleeve 134 can be considered to be a holder that rotatably retains the rotatable cutting tool 138.

Non-rotatable washer 136 has a washer body 154 that has a forward surface 156 and a rearward surface 158. Washer body 154 contains a central aperture 160 and presents a circumferential edge 162. Washer body 154 contains a single indention 164 at the circumferential edge 162 thereof. Indention 164 is geometrically like indention 84 in washer 30 so that a more detailed description is not necessary.

When the second specific embodiment of the cutting tool assembly 130 is in an assembled condition, the shank of the sleeve 134 is contained within the bore of the block 132 so that the resilient retainer retains the sleeve 134 to the block 132. When in this position, the sleeve 134 is typically non-rotatable with respect to the block 132 and the axial forward face of the block is spaced in an axial rearward direction from the rearwardly facing shoulder of the sleeve.

The cutting tool 138 is rotatably retained within the bore of the sleeve 134. In this regard, the shank of the cutting tool 138 is received within the sleeve bore in such a fashion that the resilient retainer carried by the cutting tool 138 maintains the rotatable connection between the cutting tool 138 and the sleeve 134. Intermediate of the axial forward face 148 of the sleeve 134 and the rearwardly facing shoulder of the cutting tool 138 is the non-rotatable washer 136.

The rearward surface 158 of the non-rotatable washer 136 is in contact with the axial forward face 148 of the sleeve 134. The indention 164 of the non-rotatable washer 136 is received by and registers with its corresponding scallop 150. When in the assembled condition, the indention 164 abuts against the surface defining the scallop 150 so as to create an abutment that restricts or prevents the rotational movement of the non-rotatable washer 136 relative to the sleeve 134. The forward surface 156 of the non-rotatable washer 136 is in contact with the rearwardly facing shoulder of the cutting tool 138. As is apparent, non-rotatable washer 136 is sandwiched between the axial forward face 148 of the sleeve 134 and the rearwardly facing shoulder of the cutting tool 138.

The advantages set forth in conjunction with the first specific embodiment exist in this second specific embodiment. In this regard, the non-rotatable washer protects the axial forward face of the sleeve from erosion caused by cutting debris so as to be able to prolong the useful life of the sleeve and also maintain the integrity of the milling pattern, especially in micromilling applications of ashaltic roadways. The abutment is underneath the non-rotatable washer so that it is protected or shielded from erosion caused by the cutting debris.

Figure 7:
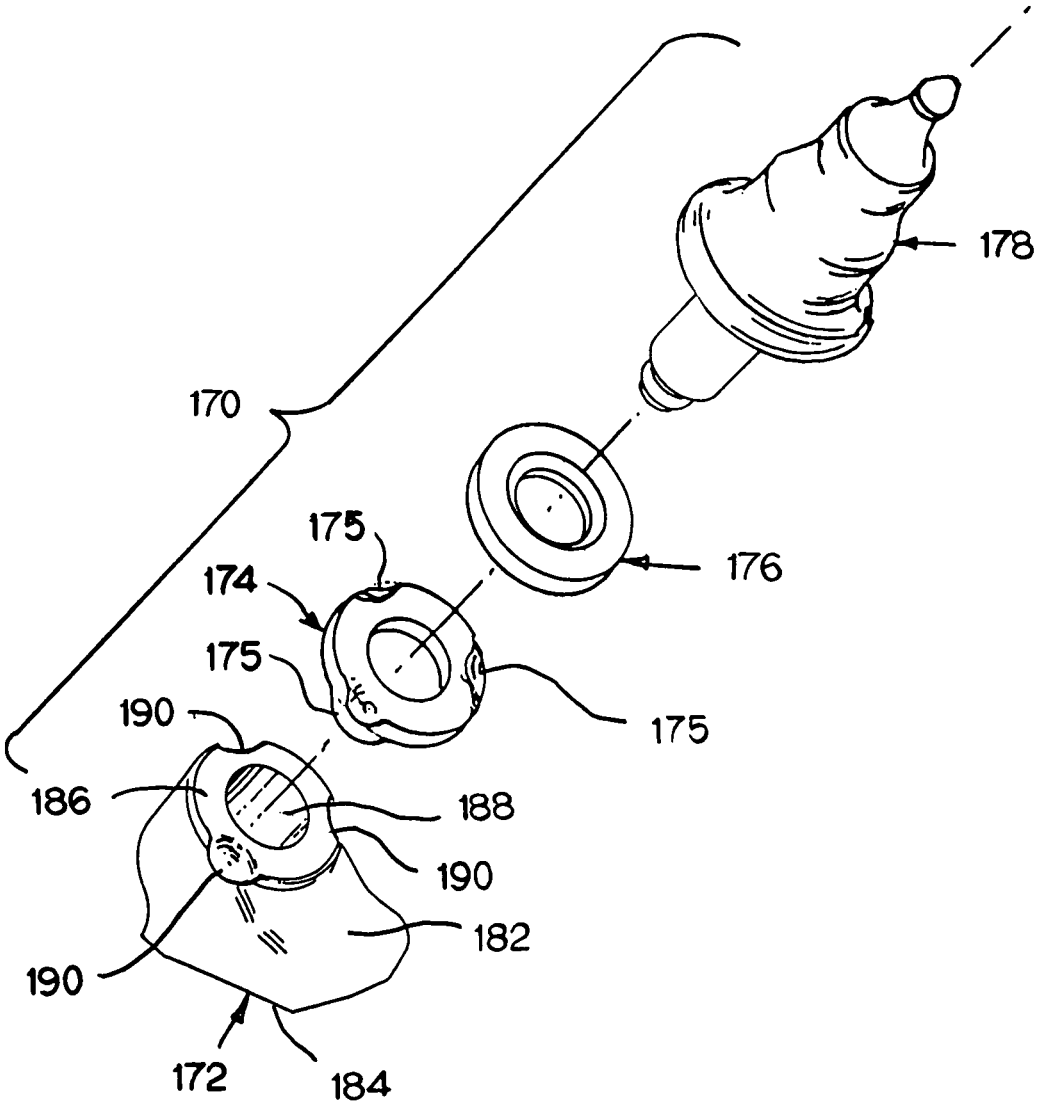
FIG. 7 is an isometric view of a third specific embodiment of a cutting tool assembly wherein the components comprise a block, a non-rotatable washer, a rotatable washer, and a cutting tool, and the components are exploded apart from each other.

Referring to FIG. 7, there is illustrated a third specific embodiment of the cutting tool assembly generally designated by brackets 170. Cutting tool assembly 170 includes a block 172, a non-rotatable washer 174, a flat washer 176 and a cutting tool 178. The cutting tool 178 is the same as cutting tool 26 so that a more detailed description is not necessary.

Non-rotatable washer 174 is structurally like non-rotatable washer 30 so that a detailed description thereof is not necessary. The washer body of the non-rotatable washer 174 has a trio of indentions 175 wherein each indention 175 is like indention 84 in washer 30. The flat washer 176 is like washer 28 so that a detailed description thereof is not necessary.

Block 172 includes a body 182 that has a base 184 and an axial forward face 186 that surrounds the axial forward end of a bore 188. The axial forward face 186 contains a trio of scallops. In this third specific embodiment, the block 172 can be considered to be a holder that rotatably retains the rotatable cutting tool.

When the third specific embodiment of the cutting tool assembly 170 is in an assembled condition, the cutting tool 178 is rotatably retained within the bore 188 of the block 172. In this regard, the shank of the cutting tool 178 is received within the block bore 188 in such a fashion that the resilient retainer maintains the connection between the cutting tool 178 and the block 172. Intermediate of the axial forward face 186 of the block 172 and the rearwardly facing shoulder of the cutting tool 178 are the non-rotatable washer 174 and the flat washer 176.

The rearward surface of the non-rotatable washer 174 is in contact with the axial forward face 186 of the block 172. The indentions 175 of the non-rotatable washer 174 are received by and register with their corresponding scallops 190 in the block 172. When in the assembled condition, the indentions 175 abut against the surfaces defining the scallops 190 so as to create three separate abutments wherein each abutment restricts or prevents the rotational movement of the non-rotatable washer 174 relative to the block 172.

The forward surface of the non-rotatable washer 174 is in contact with the rearward surface of the rotatable washer 176. Washer 176 is free to rotate relative to non-rotatable washer 174. The forward surface of the rotatable washer 176 is in contact with the rearwardly facing shoulder of the cutting tool 178. Washer 176 is free to rotate relative to cutting tool 178. As is apparent, rotatable washer 176 and the non-rotatable washer 174 are sandwiched between the axial forward face 186 of the block 172 and the rearwardly facing shoulder of the cutting tool 178.

The advantages set forth in conjunction with the first specific embodiment exist in this third specific embodiment. In this regard, the non-rotatable washer protects the axial forward face of the block from erosion due to the impingement of the cutting debris so as to be able to prolong the useful life of the block and also maintain the integrity of the milling pattern, especially in micromilling applications of ashaltic roadways. Each one of the abutments is underneath the non-rotatable washer so that it is protected or shielded from erosion caused by the debris. Further, like with the first specific embodiment, there is an advantage to having three separate abutments wherein each abutment by itself can maintain the non-rotatable condition of the non-rotatable washer.

Figure 8:
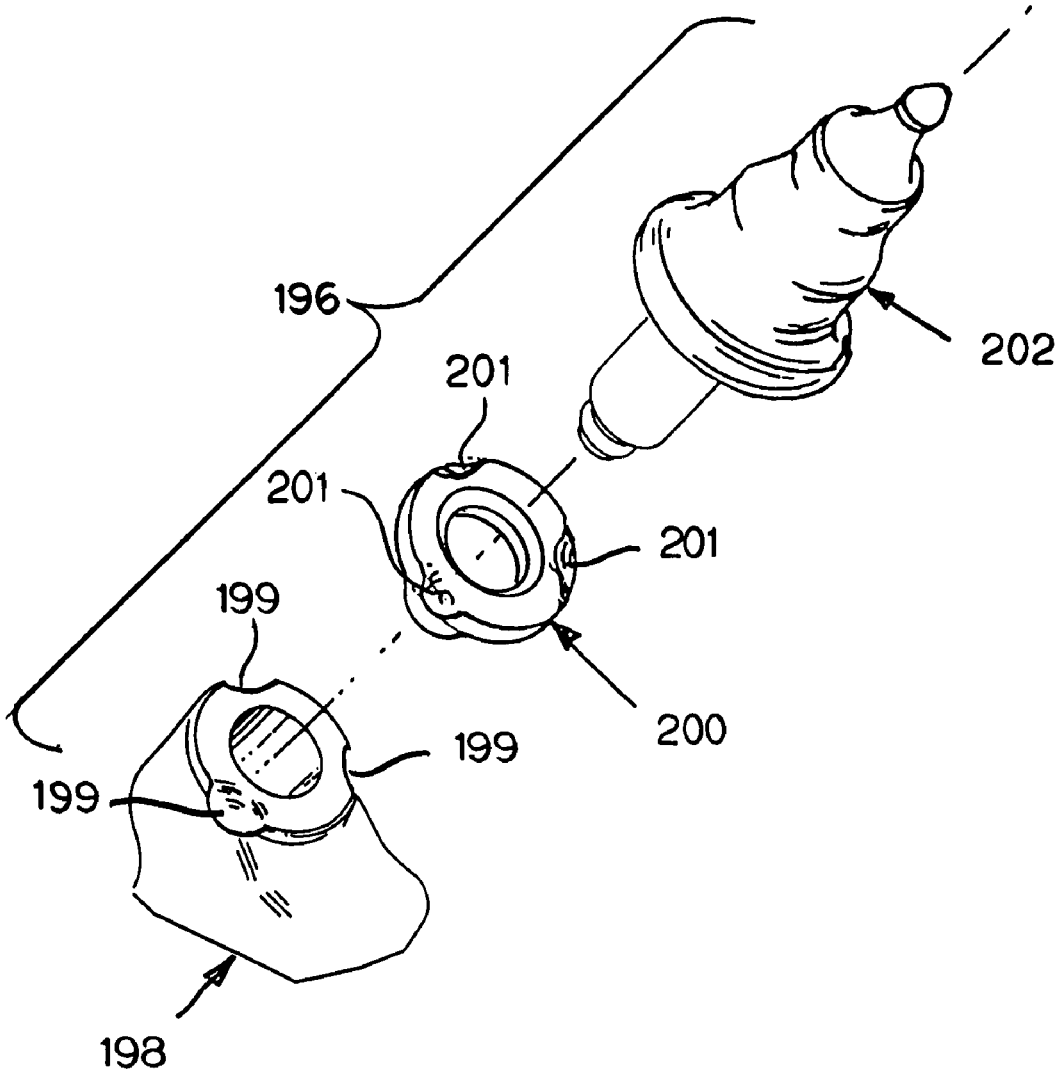
FIG. 8 is an isometric view of a fourth specific embodiment of a cutting tool assembly wherein the components comprise a block, a non-rotatable washer and a cutting tool, and the components are exploded apart from each other.

Referring to FIG. 8, there is illustrated a fourth specific embodiment of the cutting tool assembly generally designated by brackets 196. Cutting tool assembly 196 includes a block 198, a non-rotatable washer 200 and a cutting tool 202. The block 198 is structurally the same as block 172 so that a more detailed description is not necessary. Block 198 has a trio of scallops 199 wherein each scallop 199 is geometrically like scalloped. The cutting tool 202 is the same as cutting tool 26 so that a more detailed description is not necessary. The non-rotatable washer 200 is structurally the same as non-rotatable washer 28 so that a more detailed description is not necessary. Non-rotatable washer 200 has a trio of indentions 201. Each one of the indentions 201 is geometrically like indention 84 in washer 30.

When the fourth specific embodiment of the cutting tool assembly 196 is in an assembled condition, the shank of the cutting tool 202 is contained within the bore of the block 198 so that the resilient retainer retains the cutting tool 202 to the block 198. Here, the block 198 can be considered to be a holder that rotatably retains the rotatable cutting tool. When in this position, the cutting tool 198 is rotatable with respect to the block 198. Intermediate of the axial forward face of the block 198 and the rearwardly facing shoulder of the cutting tool 202 is the non-rotatable washer 200.

The rearward surface of the non-rotatable washer 200 is in contact with the axial forward face of the block 198. The indentions 201 of the non-rotatable washer 200 are received by and register with their corresponding scallops 199. When in the assembled condition, the indentions 201 against the surfaces defining the scallops 199 define three separate abutments wherein each abutment restricts or prevents the rotational movement of the non-rotatable washer 200 relative to the block 198. As is apparent, the non-rotatable washer 200 is sandwiched between the axial forward face of the block 198 and the rearwardly facing shoulder of the cutting tool 202.

The advantages set forth in conjunction with the first specific embodiment exist in this fourth specific embodiment. In this regard, the non-rotatable washer protects the axial forward face of the block from erosion so as to be able to prolong the useful life of the block and also maintain the integrity of the milling pattern, especially in micromilling applications of ashaltic roadways. The abutment is underneath the non-rotatable washer so that it is protected or shielded from erosion caused by the debris.

Figure 9:
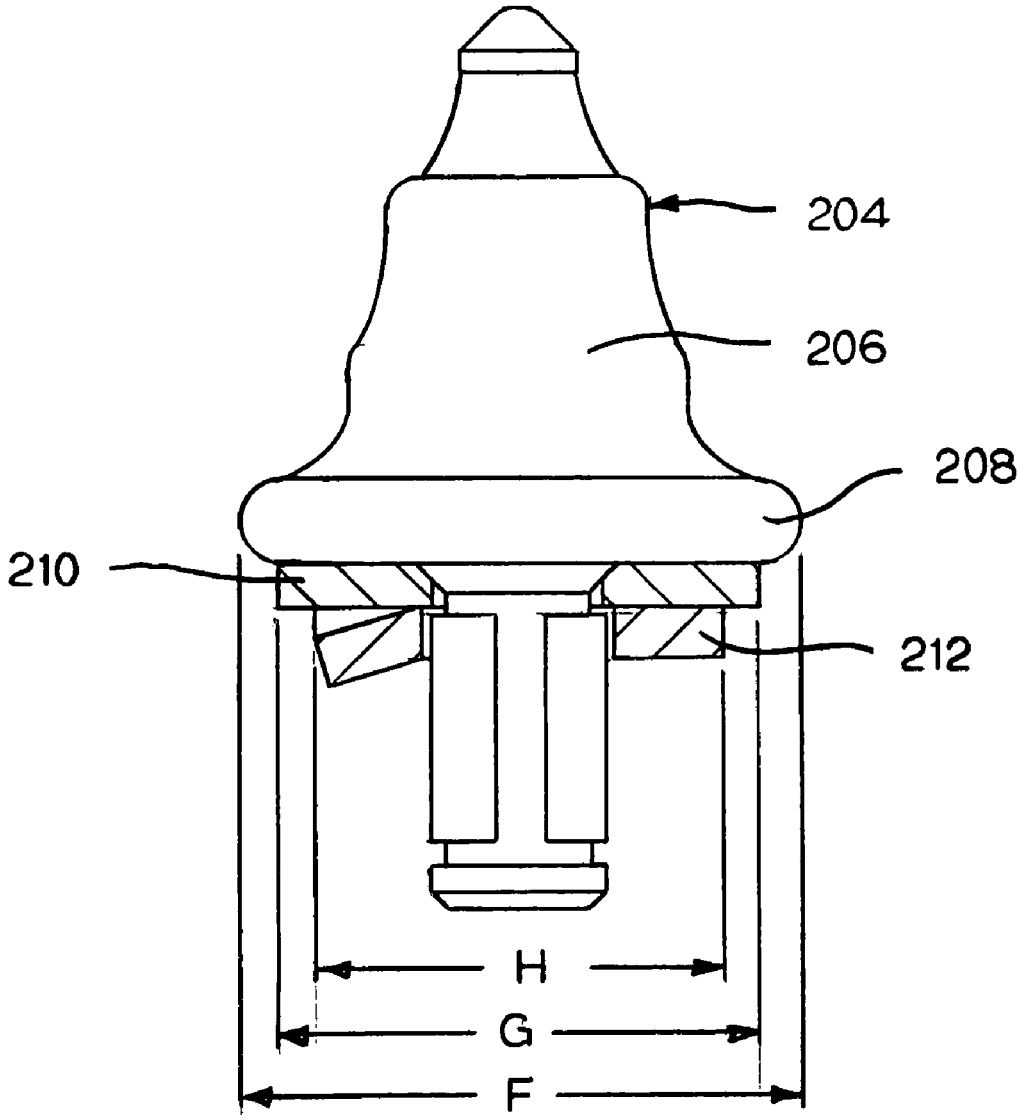
FIG. 9 is a side view of a rotatable cutting tool that carries a rotatable washer and a non-rotatable washer wherein the rotatable washer has a larger diameter than the diameter of the non-rotatable washer.

Referring to FIG. 9, there is shown a side view of a rotatable cutting tool (generally designated as 204) wherein cutting tool 204 has a cutting tool body 206 that has an enlarged diameter shoulder 208 that has a diameter "F". The rotatable cutting tool 204 carries a flat washer 210 that has a diameter "G" and a non-rotatable washer 212 that has a diameter "H". Diameter "F" is greater than diameter "G", and diameter "G" is greater than diameter "H". As mentioned above, the fact that the diameter "F" of the shoulder 208 is greater than the diameter "G" of the flat washer 210 ensures that the washer 210 does not wrap around the cutting tool 204 during operation. The fact that the diameter "G" of the flat washer 210 is greater than the diameter "H" of the non-rotatable washer 212 provides protection of the non-rotatable washer 212 from erosion.

It thus becomes apparent that the present invention provides an improved non-rotatable washer (or protective member), and an improved cutting tool (as well as a cutting tool assembly) that uses a non-rotatable washer (i.e., non-rotatable protective member). In the specific embodiments the non- rotatable washer directly engages the holder that holds the cutting tool in such a fashion so that the washer is not susceptible to wear that compromises the integrity of the non-rotatable characteristic of the washer. More specifically, the abutment (or connection) between the non-rotatable washer and the holder is underneath the washer so that the washer protects this connection from erosion due to the cutting debris.

It is also apparent that the present invention provides an improved cutting tool (as well as a cutting tool assembly) that uses a non-rotatable washer (a non-rotatable protective member) that has a high torque strength for the connection that provides for the non-rotatable feature of the washer.

It is also apparent that the present invention provides an improved cutting tool (as well as a cutting tool assembly) that uses a non-rotatable washer (i.e., a non-rotatable protective member) that can be used in conjunction with a rotatable washer.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A cutting tool assembly useful for generating cutting debris, the cutting tool assembly comprising:

a block containing a block bore;

a sleeve containing a sleeve bore wherein the bore has an axial forward end, and the sleeve having a forward surface surrounding the bore at the axial forward end of the bore;

the sleeve containing at least one scallop beginning at and extending in an axial rearward direction from the forward surface;

a cutting tool being rotatably contained within the sleeve bore;

a non-rotatable washer having a washer body with a peripheral edge, and the washer body containing at least one indention adjacent to peripheral edge; and the indention of the non-rotatable washer being received within the scallop.

2. The cutting tool assembly of claim 1 wherein the scallop presents a concave surface.

3. The cutting tool assembly of claim 1 wherein the scallop becomes shallower and narrower along the axial rearward direction.

4. The cutting tool assembly of claim 1 wherein the indention extends in an axial rearward direction.

5. The cutting tool assembly of claim 1 wherein the indention abuts against the portion of the sleeve defining the scallops so as to define an abutment that renders the non-rotatable washer non-rotatable with respect to the sleeve.

6. The cutting tool assembly of claim 5 wherein the washer body protects the abutment from erosion by the cutting debris.

7. The cutting tool assembly of claim 1 further including a flat washer, the flat washer being adjacent to and axial forward of the non-rotatable washer.

8. The cutting tool assembly of claim 7 wherein the cutting tool carrying the non-rotatable washer and the flat washer.

9. The cutting tool assembly of claim 7 wherein the flat washer is free to rotate.

10. The cutting tool assembly of claim 1 wherein the cutting tool having an enlarged diameter shoulder, and the diameter of the enlarged diameter shoulder being greater than the diameter of the non-rotatable washer.

11. The cutting tool assembly of claim 10 further including a flat washer, the flat washer being adjacent to and axial forward of the non-rotatable washer, and the diameter of the enlarged diameter shoulder being greater than the diameter of the flat washer.

12. The cutting tool assembly of claim 1 containing a plurality of scallops and a plurality of indentions.

13. A cutting tool assembly useful for generating cutting debris, the cutting tool assembly comprising:

a holder containing a bore having an axial forward end, and the holder having a forward surface surrounding the bore at the axial forward end of the bore;

the holder containing at least one scallop beginning at and extending in an axial rearward direction from the forward surface;

a cutting tool being rotatably contained within the bore of the holder;

a non-rotatable washer having a washer body with a peripheral edge, and the washer body containing at least one indention adjacent the peripheral edge; and the indention of the non-rotatable washer being received within the scallop.

14. The cutting toll assembly of claim 13 wherein the scallop presents a concave surface.

15. The cutting tool assembly of claim 13 wherein the scallop becomes shallower and narrower along the axial rearward direction.

16. The cutting tool assembly of claim 13 wherein the indention extends in an axial rearward direction.

17. The cutting tool assembly of claim 13 wherein the indention abuts against the portion of the sleeve defining the scallops so as to define an abutment that renders the non-rotatable washer non-rotatable with respect to the sleeve.

18. The cutting tool assembly of claim 17 wherein the washer body protects the abutment from erosion by the cutting debris.

19. The cutting tool assembly of claim 13 further including a flat washer, the flat washer being adjacent to and axial forward of the non-rotatable washer.

20. The cutting tool assembly of claim 19 wherein the cutting tool carrying the non-rotatable washer and the flat washer.

21. The cutting tool assembly of claim 13 wherein the cutting tool having an enlarged diameter shoulder, and the diameter of the enlarged diameter shoulder being greater than the diameter of the non-rotatable washer.

22. The cutting tool assembly of claim 21 further including a flat washer, the flat washer being adjacent to and axial forward of the non-rotatable washer, and the diameter of the enlarged diameter shoulder being greater than the diameter of the flat washer.

23. The cutting tool assembly of claim 13 containing a plurality of scallops and a plurality of indentions.

24. The cutting tool assembly of claim 13 wherein the holder comprises a block.

25. The cutting tool assembly of claim 13 wherein the holder comprises a sleeve.

26. A cutting tool assembly useful for generating cutting debris, the cutting tool assembly comprising:

a holder containing a bore having an axial forward end, and the holder having a forward surface surrounding the bore at the axial forward end of the bore;

the holder containing a plurality of scallops beginning at and extending in an axial rearward direction from the forward surface;

a cutting tool being rotatably contained within the bore of the holder;

a non-rotatable washer having a washer body with a peripheral edge, and the washer body containing at least one indention adjacent the peripheral edge wherein the number of the scallops is greater than the number of the indentions; and the indention of the non-rotatable washer being received within a selected one of the scallops wherein there is at least one of the scallops that does not receive one of the indentions.

* * * * *